United States Patent [19]

Foss

[11] Patent Number: 5,054,250

[45] Date of Patent: Oct. 8, 1991

[54] FLEXIBLE WINDOW SHIM ASSEMBLY

[75] Inventor: Robert E. Foss, Bellville, Ohio

[73] Assignee: E-Z Shim, Inc., Mansfield, Ohio

[21] Appl. No.: 510,300

[22] Filed: Apr. 17, 1990

[51] Int. Cl.[5] ..... B66F 13/00

[52] U.S. Cl. ..... 52/126.1; 52/126.5; 52/211; 52/215; 52/217; 254/104

[58] Field of Search ..... 52/126.1, 126.3, 126.5, 52/211-217, 235, 656; 254/104

[56] References Cited

U.S. PATENT DOCUMENTS

| | | | |
|---|---|---|---|
| 2,239,433 | 4/1941 | Urban | 52/126.5 X |
| 3,808,759 | 5/1974 | Carmichael | 52/212 |
| 3,906,671 | 9/1975 | Macdonado | 52/212 X |
| 4,558,548 | 12/1985 | Hieger | 52/235 |
| 4,713,922 | 12/1987 | Ingold | 254/104 X |
| 4,731,965 | 3/1988 | Jensen | 52/126.1 |
| 4,819,392 | 4/1989 | Day | 52/211 |
| 4,888,924 | 12/1989 | Grisham et al. | 52/217 |

*Primary Examiner*—Richard E. Chilcot, Jr.

*Attorney, Agent, or Firm*—Pearne, Gordon, McCoy & Granger

[57] ABSTRACT

A deformable shim assembly for positioning a closure unit in building framework defining a rough opening. The system includes a plurality of flexible, generally identical shims each having a cylindrical surface curvature to provide a convex outer surface and a concave inner surface. The forward end of each shim is tapered and is defined by side edges with an angle of intersection bisected by the axis of symmetry. The side edges also define a plane that intersects the cylindrical outer and inner surfaces at an acute angle to define a wedge-shaped space. The space has a transverse cross section in the shape of a circular segment that diminishes progressively toward the forward end of the element.

6 Claims, 2 Drawing Sheets

FLEXIBLE WINDOW SHIM ASSEMBLY

BACKGROUND OF THE INVENTION

This invention relates to the mounting of door or window units in the rough framed opening of a building under construction. More particularly, the invention relates to a wedge or shim device for accurately positioning the door or window unit in the rough framing formed prior to nailing or otherwise fastening the unit in place.

In standard building construction practice, it is customary to provide rough framed openings for installation of prefabricated door or window units. During installation. the door or window frame is held plumb and stationary prior to nailing with spacers or wedges (generally called "shims") placed between the rough framing defining the opening and the frame for the door or window unit.

Often, scraps of wood, shingles, or other construction scrap are used for this purpose. However, it is often difficult to find a shim piece of the desired size and shape to achieve the correct spacing. As a result, the installed window or door unit is often out of plumb and not square with the building walls.

Various types of prefabricated wedges, etc. have been developed for this purpose, some of which are effective but too costly, and others of which are inexpensive but limited in their effectiveness and ability to accommodate a wide range of installation situations.

Typical shim systems available in the prior art are described in the following U.S. Pat. Nos. 700.324; 4,713,922; and 4,731,965. None of these devices, however, have come into general use in the trade for reasons that include the difficulties described above.

The shim assembly of the present invention avoids the difficulties indicated above and affords other features and advantages heretofore not obtainable.

SUMMARY OF THE INVENTION

It is among the objects of this invention to provide a system by which a prefinished door or window unit may be accurately set in a rough framed opening in a building wall or partition.

Another object of the invention is to provide a system by which a door or window unit may be accurately positioned and secured within a rough framed opening on a particular centerline irrespective of the actual location of the sides or jambs of the opening, and whether or not the framing outlining the sides of the opening are plumb.

Still another object of the invention is to provide an improved method and device for setting prefinished door or window frames in the opening of a wall so as to ensure a true and absolute centering and squaring of the door or window unit so that the door or window, when positioned therein, wil! be free from binding at all points within the frame.

A further object is to provide a system by which improperly set or skewed cripple studs that define the sides of a doorway or window opening may be modified to provide a series of vertically aligned contact points for centering a door or window unit in the opening with the side jambs in perfect parallelism and vertical with respect to a plumb line established between the jambs extending at right angles through the doorway opening.

These and other objects and advantages of the invention are achieved by the unique system and device of the present invention, which resides in a deformable shim for positioning a closure unit in building framework defining a rough opening. The system includes a plurality of flexible, generally identical shim elements formed of resilient material, each element having a cylindrical surface curvature to provide a convex outer surface and a concave inner surface formed about a remote cylinder axis.

Each element has a longitudinal axis of symmetry that is also a generatrix of the cylindrical surface curvature. The forward end of the shim is tapered and is defined by side edges with an angle of intersection bisected by the axis of symmetry. The side edges also define a plane that intersects the cylindrical outer and inner surfaces at an acute angle to define a wedge-shaped space. The space has a transverse cross section in the shape of a circular segment that diminishes progressively toward the forward end of the element.

On or more of the shim elements may be inserted front end first, in the same orientation in the space between the building framework and a door or window assembly to be installed. The front end of the element or group of elements is inserted in the space between the rough opening and the closure unit. A sufficient number of the elements are inserted together and hammered in place, to shim the closure unit into a desired position relative to the rough frame opening.

In accordance with one aspect of the invention, the upper and lower surfaces of the shim elements are provided with ridges and grooves, respectively, to ensure stacking integrity during installation. The ridges and grooves extend parallel to the axis of symmetry of the element.

DESCRIPTION OF THE PREFERRED EMBODIMENT

Figure 1:
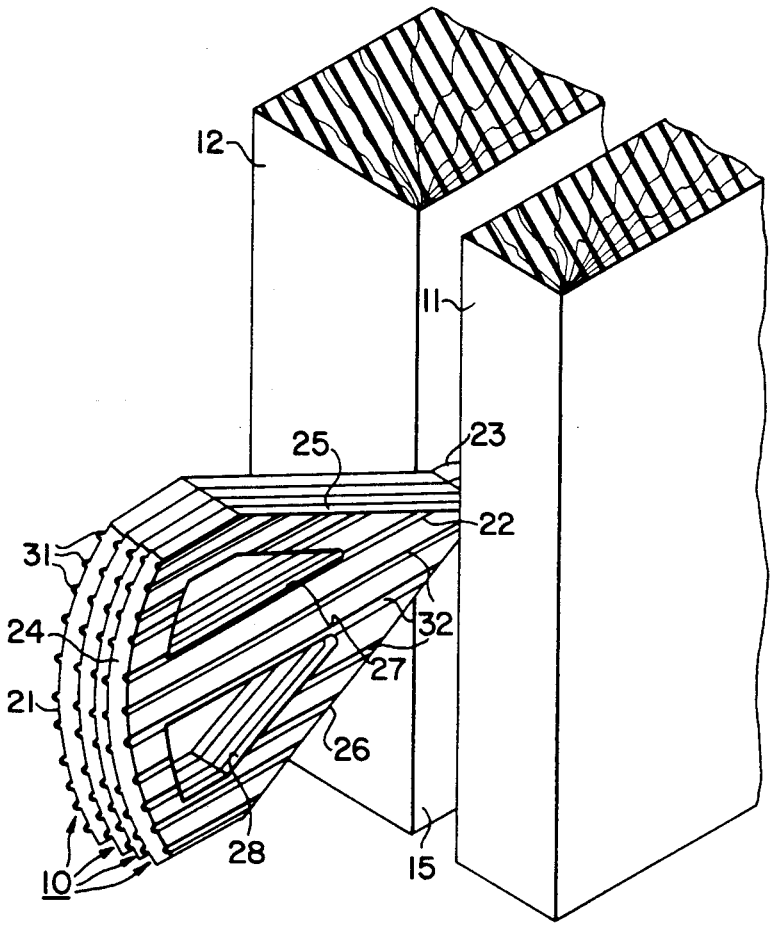
FIG. 1 is a perspective view illustrating the use of shims of the present invention, to properly space a door or window unit from the adjacent surface of rough framing that defines the opening.
Figure 2:
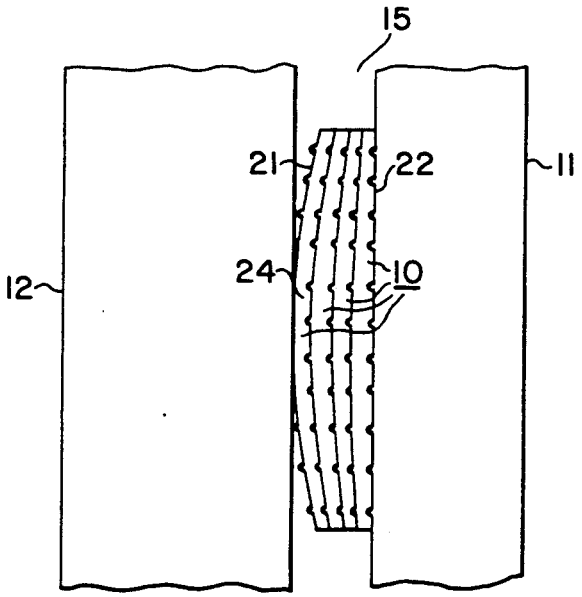
FIG. 2 is a fragmentary elevational view illustrating three shims embodying the invention, positioned in the space between a rough frame opening and a door or window unit to be installed therein.

Referring more particularly to the drawings, and initially to FIGS. 1 and 2, there is shown a number of identical shims 10 embodying the present invention and adapted for use in properly aligning and positioning a window unit 11 in an opening defined by rough frame members, including the member or stud 12. While the shims 10 may be used to position and align either prefabricated door or window units, for the purpose of the present description, the method will be described with respect to a preformed window unit 11. As is normally the case, the opening is built slightly larger than the window unit so that there is a space 15 between the sides of the window unit and the rough frame member 12.

The purpose of the present invention is to insert wedges or shims into the space 15 to achieve an accurate, plumb alignment of the window unit in the rough framing. The result of the use of the shims 10 of the present invention is illustrated in FIG. 2.

Each of the identical shims 10 formed in accordance with the invention has a curved top surface 21 of a generally convex shape and a curved bottom surface 22 of a generally concave shape. The curvature is generally cylindrical about a remote cylinder axis. The shims 10 are preferably formed of a moldable plastic material and are relatively stiff, although sufficient flexibility or resiliency is available to flex the shims out of their curved condition into a planar or flat condition, if desired. Also, each shim element has a tapered forward end 23 and a relatively flat, rearward end 24.

The taper of the forward end 23 is defined by intersecting side edges 25 and 26, the angle of intersection of which is bisected by a central axis of symmetry. The furthest forward portion of the forward end 23 is rounded although the particular shape is not critical.

Also, each shim 10 preferably has a thickness that varies from a maximum dimension along the central axis of symmetry to a minimum dimension at its side edges spaced furthest from the central axis. This is best illustrated in FIG. 2.

Figure 3:
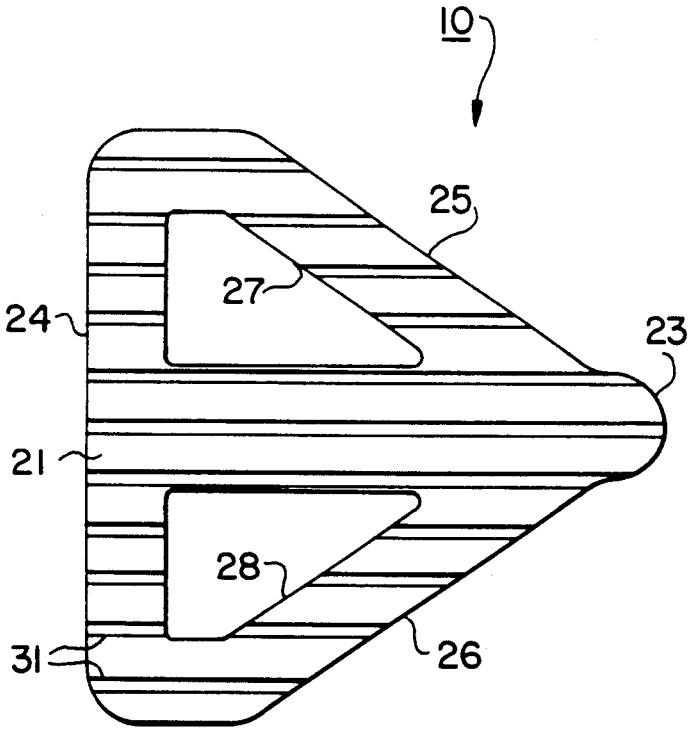
FIG. 3 is a plan view of a shim formed in accordance with the invention and shown in actual size.
Figure 4:
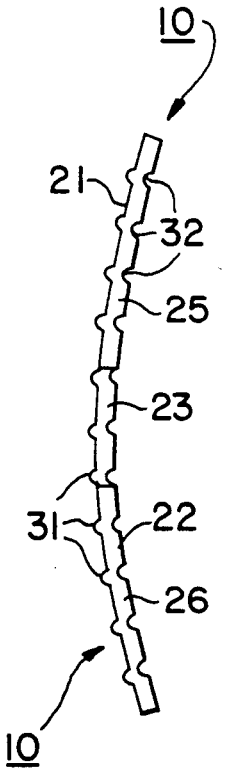
FIG. 4 is an end elevation of the shim of FIG. 3.
Figure 5:
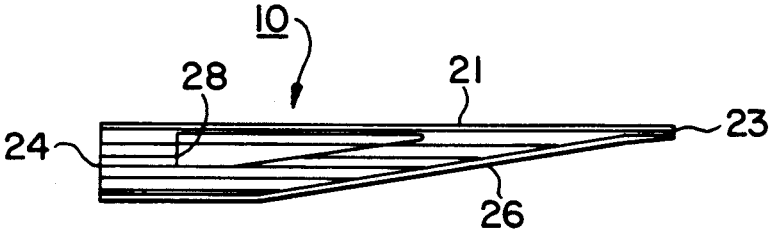
FIG. 5 is a side elevation of the shim of FIG. 3.

The shim may be provided with a pair of openings 27 and 28 primarily to reduce material costs, as illustrated in FIG. 3, the openings being preferably symmetrical about the central axis of symmetry.

In accordance with one aspect of the invention, the upper surface 21 is provided with a plurality of ridges 31 that extend parallel to the axis of symmetry and the bottom surface 22 is provided with a plurality of corresponding longitudinal grooves 22. These aid in holding the shims in place relative to one another It will be noted that the side edges 25 and 26 define a plane that intersects the cylindrical top and bottom surfaces in such a way as to define a wedge-shaped space below the bottom surface 22. The wedge-shaped space when viewed in transverse cross section, defines a circular segment that decreases in size progressively from the rearward end to the forward end of the shim. It is the wedge-shaped aspect of the form of the shim that lends it effectiveness and convenience in performing the shimming operation.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. An adjustable shim assembly for positioning a closure unit in building framework defining a rough opening, comprising:

a plurality of flexible, generally identical shim elements formed of resilient material of generally uniform thickness, each element having a convex outer surface and a concave inner surface, a longitudinal axis of symmetry, a tapered forward end defined by side edges with an angle of intersection bisected by said axis of symmetry, said edges also defining a plane that intersects said outer and inner surfaces at an acute angle to define a wedge-shaped space with a transverse cross section that diminishes progressively toward said forward end, whereby said shim elements may be inserted forward end first in the same orientation, in the wedge-shaped space defined by the preceding element, between a frame portion and a closure assembly to shim said closure assembly into a desired position relative to said rough opening

2. A shim assembly as defined in claim 1, wherein each shim has a cylindrical surface curvature formed about a remote cylinder axis extending parallel to said axis of symmetry.

3. A shim assembly as defined in claim 1, wherein said one of said convex outer surface and said concave inner surface is provided with a plurality of ridges extending parallel to said longitudinal axis and said other of said concave outer surface and said convex inner surface has a plurality of matching grooves extending parallel to said longitudinal axis whereby the ridges of one shim interfit with the grooves of an adjacent shim.

4. A shim assembly as defined in claim 1, wherein said shims are formed of a resilient plastic material.

5. A shim assembly as defined in any of claims 1 through 4, wherein each shim has a thickness that varies from a maximum dimension along its respective longitudinal axis to a minimum dimension at its side portion spaced furthest from said longitudinal centerline.

6. An adjustable deformable shim device for positioning a closure unit in building framework defining a rough opening, comprising:

a plurality of flexible, generally identical shim elements formed of resilient material, each element having a cylindrical surface curvature to provide a convex outer surface and a concave inner surface formed about a remote cylinder axis, a longitudinal axis of symmetry comprising a generatrix of said cylindrical surface of curvature, a tapered forward end defined by side edges with an angle of intersection bisected by said axis of symmetry, said edges also defining a plane that intersects said cylindrical outer and inner surfaces at an acute angle to define a wedge-shaped space with a transverse cross section in the shape of a circular segment that diminishes progressively toward said forward end, whereby said shim elements may be inserted forward end first in the same orientation, between a frame portion and a closure assembly to shim said closure assembly into a desired position relative to said rough opening.

* * * * *